US006012703A

United States Patent [19]

Hayashi et al.

[11] Patent Number: 6,012,703

[45] Date of Patent: Jan. 11, 2000

[54] VALVE GUIDE AND PROCESS FOR MANUFACTURING THEREOF

[75] Inventors: Koichiro Hayashi; Katsunao Chikahata, both of Matsudo, Japan

[73] Assignee: Hitachi Powdered Metals Co., Ltd., Chiba-ken, Japan

[21] Appl. No.: 08/890,655

[22] Filed: Jul. 9, 1997

[30] Foreign Application Priority Data

Jul. 10, 1996 [JP] Japan ..... 8-199687

[51] Int. Cl.[7] ..... F01L 3/02

[52] U.S. Cl. ..... 251/368; 123/188.3

[58] Field of Search ..... 123/188.3, 188.8, 123/90.1; 251/368

[56] References Cited

U.S. PATENT DOCUMENTS

| | | | |
|---|---|---|---|
| 4,583,502 | 4/1986 | Takahashi et al. | 123/90.39 |
| 4,632,074 | 12/1986 | Takahashi et al. | 123/90.39 |
| 4,723,518 | 2/1988 | Kawasaki et al. | 123/188 |
| 4,936,270 | 6/1990 | Ushio et al. | 123/193 |
| 5,257,453 | 11/1993 | Neumann et al. | 29/888.4 |
| 5,792,289 | 8/1998 | Morton et al. | 148/421 |
| 5,870,989 | 2/1999 | Takahashi et al. | 123/188.3 |

FOREIGN PATENT DOCUMENTS

| | | |
|---|---|---|
| 50-96714 | 1/1975 | Japan . |
| 51-34858 | 10/1976 | Japan . |
| 55-17100 | 1/1980 | Japan . |
| 9-53421 | 2/1997 | Japan . |
| 9-53422 | 2/1997 | Japan . |
| 9-53423 | 2/1997 | Japan . |

*Primary Examiner*—A. Michael Chambers
*Attorney, Agent, or Firm*—Scully, Scott, Murphy & Presser

[57] ABSTRACT

Disclosed is a valve guide which is manufactured by a sintered alloy and used for an engine, and more particularly, to a valve guide which has high wear resistance and can prevent appearance of scuffing on a surface of a valve stem associated with the valve guide, and to a process for manufacturing the valve guide. The valve guide comprises an inner surface sliding with a valve stem, the inner surface finished by machining and exposing pores. Area-ratio of the pores with respect to the inner surface is 2.7 to 10.7%, and at least one pore having pore size of not less than 80 $\mu$m exists per 1 $mm^2$ of the inner surface.

7 Claims, No Drawings

VALVE GUIDE AND PROCESS FOR MANUFACTURING THEREOF

BACKGROUND OF THE INVENTION

1. Field of the Invention

The present invention relates to a valve guide which is manufactured by a sintered alloy and used for an engine, and more particularly, to a valve guide which has high wear resistance and can prevent appearance of scuffing on a surface of a valve stem associated with the valve guide, and to a process for manufacturing the valve guide.

2. Description of the Prior Art

For use of engines of automobiles and the like, various valve guides manufactured by sintered alloy have been provided. Such type of the valve guide includes some hard phase in order to obtain wear resistance. For example, the applicant of the invention discloses a valve guide including hard phase consists of Fe—P—C eutectic compound (called steadite) in Japanese Patent Publication Nos. 1980-34858 and 1989-52463. The sintered alloy valve guide is manufactured in a way that a green compact is sintered, and is pressed fit into a cylinder head of an engine. Then, reaming is carried out to the inner surface of the sintered body, so that the valve guide is completed. Lubricating oil is provided to the valve guide by an oil feeding system provided to the engine, so that lubricating oil flows through pores in the valve guide, and exudes to a sliding portion between the valve guide and a valve stem supported thereby.

When quantity of lubricating oil exuding to the sliding portion is not enough, the surface of the valve guide becomes scratched and chipped by wear, that is to say, scuffing appears on the valve stem. On the contrary, when lubricating oil can easily flow through the pores, a large quantity of lubricating oil exudes to the sliding portion. As a result, lubricating oil leaks from the sliding portion and is sucked into the engine chamber due to negative pressure thereof, so that exhaust gas includes white smoke. Therefore, the valve guide is required to flow suitable quantity of lubricating oil through the pores. Furthermore, the valve guide is required to have not only wear resistance but also machinability which is important quality. However, as mentioned above, because the valve guide manufactured by sintered alloy includes hard phase dispersed in the structure, machining of the valve guide is difficult. Therefore, the applicant proposed a valve guide having improved machinability in Japanese Patent Laid Open No. 1992-57140 maintaining wear resistance of the valve guide disclosed in the above mentioned Japanese Patent Publication No. 1980-34858. However, a need exists for a valve guide having further improved machinability.

As mentioned above, the valve guide is required to have various performances at high level.

SUMMARY OF THE INVENTION

Therefore, it is an object of the present invention to provide a valve guide and a process for manufacturing thereof which can meet the above need.

The inventors of the present invention researched reason of appearance of scuffing on a valve stem, as a result, they found the reason was that pores exposed on an inner surface of the valve guide were closed by machining thereof. Then, the inventors researched relationships between pores exposed on the inner surface of the valve guide after machining and appearance of the scuffing, as a result, they found that pore size had to be more than a stated value, by the reason that pores exposed on the inner surface of the valve guide did not penetrate to inside pores when the pore size was small, and pores having a small pore size could be easily filled up by machining. In the explanation, the pore size means the diameter of an assumed circle having the same area that measured pore has. Furthermore, even if pores have large pore size, the valve guide may partially lubricated when pores are unevenly distributed on the inner surface. Additionally, area-ratio of pores on the inner surface is one of important factors in order to provide enough lubricating oil to the inner surface. The present invention is completed based on various experiments according to the above mentioned knowledge.

In accordance with the present invention, there is provided a valve guide manufactured by sintered alloy, the valve guide comprising an inner surface sliding with a valve stem, the inner surface finished by machining and exposing pores, area-ratio of the pores with respect to the inner surface being 2.7 to 10.7%, and at least one pore having not less than 80 $\mu$m of pore size existing per 1 $mm^2$ of the inner surface. The reason of the above numerical limitation will be explained together with effects of the present invention.

In accordance with the experiments carried out by the inventors, scuffing appeared on a valve stem when the area-ratio of pores exposing on the inner surface of the valve guide was 2.5%, while scuffing did not appear on the valve stem when the area-ratio was 3.0%. Therefore, the border whether scuffing appears will be the average of the above numerical values, so that the inventors established the minimum area-ratio of 2.7%. In order to effectively prevent scuffing, minimum area-ratio is preferably 3.0%, and more favorable result will be obtained if the minimum area-ratio is 4.0%.

Furthermore, the inventors researched relationship between area-ratio and leak of lubricating oil. The research was carried out in a way that an end portion of a valve guide was inserted in a vacuum tank, and the other end portion of the valve guide was projected from the vacuum tank. Then, lubricating oil was provided to the projected end portion of the valve guide, and the pressure of the tank was reduced to negative pressure generally equal to intake pressure of an engine. Through this operation, the inventors observed whether lubricating oil leaked in the vacuum tank. The result of the research, lubricating oil leaked when the area-ratio was 11.4%, while lubricating oil did not leak when the area-ratio was 10.0%. Therefore, the inventors established the maximum area-ratio of 10.7% which was the average of the above numerical values. In order to effectively prevent leak of lubricating oil, maximum area-ratio is preferably 10.0%.

Thus, in the present invention, the area-ratio of the pores exposed on the inner surface, can be either of these ranges, 2.7 to 10.0%, 3.0 to 10.0%, 4.0 to 10.0%, 3.0 to 10.7% and 4.0 to 10.7%.

Moreover, the inventors researched particle size and distribution of pores, and found that even if the area-ratio was in the range of the present invention, scuffing appeared when at least one pore having not less than 80 $\mu$m of pore size did not exist per 1 $mm^2$ of the inner surface. Therefore, the above numerical limitation was adopted to the present invention.

Number and particle size of the pores are naturally limited since the area-ratio of the pores is no more than 10.7% (preferably 10.0%). As means for machining of the inner surface, end-mil, drill, grinder, vanisher and the like can be used. Considering convenience and high accuracy, reamer is most suitable for machining.

Chemical composition of the valve guide of the present invention can be properly chosen. For example, the valve guide can be manufactured by a sintered alloy comprising 1.0 to 10.0% by weight of Cu, 0.6 to 1.2% by weight of C, no more than 3% by weight of Ni, and balance of Fe and inevitable impurity, matrix structure constructed by essentially pearlite or composite structure of pearlite and bainite, with no hard phase. The matrix structure can be constructed by only pearlite or composite structure of pearlite and bainite, or ferrite and/or martensite can be included in a part of the matrix structure. Ni is optionally included in the sintered alloy. Therefore, the sintered alloy may be Fe—Cu—Ni—C sintered alloy when Ni is included therein, the sintered alloy may be Fe—Cu—C sintered alloy when Ni is not included therein.

In the valve guide according to the present invention, inner surface thereof can be suitably lubricated by lubricating oil, so that wear resistance can be improved although hard phase such as steadite (Fe—P—C eutectic compound) is not included. Additionally, as the composite structure is constructed by essentially pearlite or composite structure of pearlite and bainite, with no hard phase, machinability can be improved. Following is the reason of the numerical limitation of the above elements.

Cu: Cu is mixed to strengthen the matrix. If content of Cu is less than 1.0% by weight, necessary radial crush strength of a sintered body can not be obtained. On the contrary, if content of Cu is more than 10.0% by weight, amount of Cu exceeds limit of solid solution thereof, so that considerable amount of Cu is retained in the matrix, this result in decline of strength. Furthermore, retained Cu result in dispersion of martensite in the matrix, so that machinability is declined.

C: C is mixed to form pearlite in the matrix, so that strength of the matrix and wear resistance increase. If content of C is less than 0.6% by weight, amount of pearlite decreases, so that the above advantages can not be obtained. On the contrary, if content of C is more than 1.2% by weight, brittle cementite reticulately precipitates at grain boundary, so that strength and machinability decrease.

Ni: Ni is mixed to be diffused in the matrix, so that hardness of the matrix increases. As strength of the matrix increases, plastic flow of the matrix decreases when machining is carried out to the inner surface of the valve guide. Therefore, pores exposed on the inner surface are retained thereon. If content of Ni is more than 3.0% by weight, a portion of matrix transforms to martensite that is hard, so that machinability declines and accelerates wear of valve associated with the valve guide. Moreover, a portion in which Ni does not quickly diffuse is retained in a phase of austenite, so that built-up edge is easily formed on an edge of cutting tool when machining is carried out, and this result in decline of machinability.

In the present invention, at least one of 0.01 to 0.5% by weight of BN (hexagonal boron nitride) and 0.05 to 1.0% by weight of $MgSiO_3$ (e.g. enstatite) can be included. These additional elements are effective as solid lubricant, and function for breaking chips produced during machining (chip breaker effect), so that machinability is further improved. As a result of improvement of machinability, cutting force loaded to the matrix by a cutting tool when the inner surface is machined decreases, so that plastic flow of the matrix can be controlled to small levels. The minimum values of the above numerical limitation are at least necessary minimum content to obtain the above advantages. On the contrary, if the above elements are included too much, progress of sintering is obstructed. For this reason, the maximum values of the above limitation are established.

In case of mixing BN, composite powder consist of Fe powder pre-alloyed with BN (disclosed in Japanese Patent Laid Open No. 1991-79701) is advantageously used since BN is evenly disperses in the matrix.

Moreover, no more than 0.2% by weight of P can be mixed since P progresses sintering and strengthens the matrix. If content of P is more than 0.2%, steadite precipitates in the matrix, so that machinability declines.

Additionally, in the valve guide according to the present invention, the area-ratio of pores and number of pores having the particle size of the present invention can be established by optional means. For example, machining condition can be suitably set up so as to obtain the above numerical limitations. In this manner, no more than 3% by weight of Ni can be mixed, so that the area-ratio can be increased since plastic flow of the matrix by machining decreases. Furthermore, by using coarse powder as mentioned below, the valve guide according to the present invention can be manufactured. The following is a process for manufacturing a valve guide according to the present invention.

Particle size distribution of Fe powder used for manufacturing a conventional valve guide is about 20% by weight of not less than 105 $\mu$m to less than 177 $\mu$m of particle size, about 55% by weight of not less than 44 $\mu$m to less than 105 $\mu$m of particle size and about 25% by weight of less than 44 $\mu$m of particle size. As the conventional valve guide was manufactured by using such a Fe powder, amount of pores exposed on an inner surface after machining was not sufficient, so that lubrication of a sliding portion was not sufficient and scuffing easily appeared.

The inventors of the present invention researched relationship between particle size distribution of Fe powder and appearance of scuffing, and found the relationship which enables to provide sufficient amount of lubricating oil to the sliding portion. The process for manufacturing a valve guide of the invention is based on the above relationship, and comprises the steps of preparing powdered mixture comprising not less than 85% by weight of Fe powder having 74 $\mu$m to 250 $\mu$m of particle size, compressing the powdered mixture to form a green compact having an inner surface, sintering the green compact, and machining the inner surface.

In the process for manufacturing a valve guide according to the invention, by using the powder consisting of coarse particle such as the above, when a green compact is formed, gaps between particles become large, and particles support one another so as to form bridging of a shape, so that large gaps are formed in the green compact. Therefore, when the green compact is sintered, large pores are formed. Moreover, when machining to the inner surface of the valve guide is carried out, although some pores exposed on the inner surface are closed due to plastic flow of the matrix, sufficient amount of pores having sufficient pore size are retained. According to the experiments performed by the inventors, scuffing appeared when 80% by weight of Fe powder having the above pore size was included. However, scuffing did not appear when 90% by weight of the Fe powder was included, and exceeding good result was obtained when 95% by weight of the Fe powder was included.

Therefore, in the present invention, particle size of not less than 85% by weight of Fe powder is not less than 74 $\mu$m (200 plus mesh) to no more than 250 $\mu$m (60 minus mesh). Preferably, the Fe powder having the above particle size is not less than 90% by weight, more preferably not less than 95% by weight. Additionally, the particle size of the Fe powder is preferably not less than 105 μm (145 plus mesh) and no more than 250 μm.

Although the manufacturing process of the invention is not limited to manufacture only the valve guide of the invention, of course arrangement can be made to the invented manufacturing process. That is to say, the above powder can be pressed to form a green compact and sintered, then, can be machined so as to obtain area-ratio of the pores with respect to the inner surface being 2.7 to 10.7%, and at least one pore having not less than 80 μm of pore size existing per 1 $mm^2$ of the inner surface.

Particle size of Fe powder corresponds particle size of matrix of sintered alloy. On a microstructure of a section of the sintered alloy, in the case that particle size of a particle which the section pass off-set the center thereof, the particle size is measured smaller compared to the actual particle size. According to the research of the inventors, when 5% by weight of powder having less than 74 μm of particle size, the area-ratio of the particle having less than 74 μm of particle size is 10% with respect to area of the matrix. Moreover, when 10% by weight of powder having less than 74 μm of particle size, the area-ratio of the particle having less than 74 μm of particle size is 15% with respect to area of the matrix.

According to another aspect of the present invention, it is provided a process for manufacturing a valve guide specified in claim 4, comprising the steps of preparing powdered mixture comprising Cu powder, the Cu powder including not less than 25% by weigh of Cu powder having not less than 74 μm to no more than 250 μm of particle size, compressing the powdered mixture to form a green compact having an inner surface, sintering the green compact, and machining the inner surface.

The Cu powder strengthens the matrix by solid solution therein during sintering. After diffusion of Cu, a pore is formed at the portion where Cu particle has been (Kirkendall effect). The pore size of the pore corresponds particle size of the Cu powder. According to the experiments carried out by the inventor, scuffing appeared when 20% by weight of the Cu powder was mixed, while scuffing did not appear when 30% by weight of the Cu powder was mixed. Therefore, in the present invention, the minimum limitation of content of the Cu powder is 25% by weight. Preferably, the Cu powder may be included not less than 30% by weight.

In the present invention, content of the Cu powder is 1.0 to 10.0% by weight, which is small with respect to entire component. Therefore, although the coarse Cu powder in the range of not less than 74 μm to no more than 250 μm can be used without leak of lubricating oil.

The reason that the maximum limitations of the particle size are established in the above two manufacturing process is to prevent leak of lubricating oil. Furthermore, In the manufacturing processes, by mixing no more than 3% by weight of Ni with the powder, plastic flow of the matrix by machining decreases and the area-ratio of the pores can be increased.

The features and advantages of the valve guide and manufacturing process thereof will be more clearly understood from the following description of preferred embodiments of the present invention.

DETAILED DESCRIPTION OF THE PRESENT INVENTION

The following is description of samples of the valve guides of the present invention and samples of the conventional valve guides. In the following description, the mixture ratio and the chemical composition are based on weight.

A. EXAMPLE 1

[Manufacture of Samples]

5% of a Cu powder and 1% of a graphite powder were blended with some Fe powders having various particle size distribution, then the powdered mixtures were compacted to form ring-shape test pieces having a density of 6.8 $g/cm^3$. Then, the green compacts were sintered in a reducing atmosphere at a temperature of 1,130° C. for 60 minutes. After this, reaming was carried out to a bore of each test piece by using a cemented carbide reamer with a diameter of 8 mm. The test pieces were reamed with a cutting speed of 950 rpm and a feed per revolution of 0.4 mm/rev.

[Valuation of Sliding Portion]

Each sample was impregnated with lubricant oil, then installed to a vertical valve guide wear tester and carried out an wear test. The wear tester had a construction that a valve was installed to a lower end of a vertical piston movably equipped to the wear tester, the sample was installed to the wear tester and was penetrated by a valve stem of the valve, and the valve was moved reciprocately with applying a lateral load. The wear test was carried out at a stroke frequency of 3000 rpm with a stroke length of 8 mm. The lateral load applied to the piston (valve) was 3 kgf, and the wear test was carried out in an exhaust gas at a temperature of 200° C. for 30 hours. After the wear test, a surface of the valve stem was observed. The result of appearance of scuffing and a valuation thereof are shown in Table 1. In remark in Table 1, "good" was the case that ordinary wear appeared on the valve stem, "best" was the case that the surface of the valve stem was smooth and very good condition although wear was appears thereon.

[Observation of Oil Leak]

Appearance of oil leak of the samples was observed by using an oil permeation measuring apparatus. The detail of the measuring apparatus is follow.

The measuring apparatus has a decompression tank having an opening at the top thereof. An oil tank having an opening at the top thereof is attached to the top of the oil tank so as to form an air tight chamber in the decompression tank. A holder is provided at the bottom of the oil tank and is designed so as to hold a sample air tightly in a way that an end of the sample is projected from the oil level, and another end of the sample is inserted in the air tight chamber.

In the experiment, a sample impregnated with lubricant oil was held by the holder. Then, lubricating oil was provided to the projected end of the sample, and the pressure of the decompression tank was reduced to a negative pressure generally equal to an intake pressure of an engine. This condition was held for predetermined holding time, and observed that lubricating oil was dripped in the decompression tank or not. In the experiment, the pressure in the decompression tank was 400 mmHg, and the holding time was 300 minutes. The result of oil leak and a valuation thereof is shown in Table 1 together.

TABLE 1

| Sample No. | Area-Ratio (%) | Number of pores having assorted size n/mm² 300 μm≦ | 150 μm≦~ <300 μm | 80 μm≦~ <150 μm | <80 μm | Valuation | Remark |
|---|---|---|---|---|---|---|---|
| 1 | 1.3 | 0 | 0 | 0 | Much | No Good | Scuffing |
| 2 | 2.5 | 0 | 0 | 1 | Much | No Good | Scuffing |
| 3 | 3.0 | 0 | 0 | 1 | Much | Good | Good |
| 4 | 3.2 | 0 | 0 | 0 | Much | No Good | Scuffing |
| 5 | 3.4 | 0 | 0 | 1 | Much | Good | Good |
| 6 | 4.2 | 0 | 1 | Several | Much | Very Good | Best |
| 7 | 4.4 | 0 | 0 | 0 | Much | No Good | Scuffing |
| 8 | 4.9 | 0 | 1 | Several | Much | Very Good | Best |
| 9 | 5.2 | 0 | 1 | 2 | Much | Very Good | Best |
| 10 | 6.8 | 0 | 0 | 0 | Much | No Good | Scuffing |
| 11 | 7.5 | 0 | 2 | Several | Much | Very Good | Best |
| 12 | 8.1 | 0 | 2 | 1 | Much | Very Good | Best |
| 13 | 8.2 | 0 | 0 | 0 | Much | No Good | Scuffing |
| 14 | 9.2 | 0 | 1 | 5 | Much | Very Good | Best |
| 15 | 9.5 | 0 | 3 | Several | Much | Very Good | Best |
| 16 | 9.7 | 0 | 2 | 1 | Much | Very Good | Best |
| 17 | 10.0 | 0 | 1 | 10 | Much | Good | Good |
| 18 | 11.4 | 0 | 4 | Several | Much | No Good | Oil Leak |
| 19 | 12.5 | 0 | 3 | 2 | Much | No Good | Oil Leak |
| 20 | 16.8 | 0 | 0 | 0 | Much | No Good | Scuffing |
| 21 | 22.7 | 2 | 1 | 2 | Much | No Good | Oil Leak |
| 22 | 25.8 | 3 | 2 | Several | Much | No Good | Oil Leak |

[Measuring Area-Ratio and Pore Size]

Each sample was cut and an inner surface thereof was observed by a microscope, and amount of area of pores in the entire view of the microscope was measured. The ratio of the amount of area of the pores in the view with respect to the area of the entire view (area-ratio) was calculated. The calculated area-ratio is shown in Table 1 together. Pore size of the pores in the view was measured, and measured pore size were assorted by the range of less than 80 μm, not less than 80 μm to less than 150 μm, not less than 150 μm to less than 300 μm and not less than 300 μm, and number of the pores corresponding the above assortment in 1 mm² of the inner surface was counted. The number of the pores is shown in Table 1 together. The following is the check of the numerical limitation of the present invention based on the result in Table 1.

[Check of Numerical Limitation]

(1) Area-Ratio (2.7 to 10.7%)

In sample Nos. 1 and 2 which the area-ratio were below the minimum limitation of the invention, scuffing appeared on an inner surface of a valve stem. In sample Nos. 18, 19, 21 and 22 which the area-ratio were above the maximum limitation of the invention, lubricating oil dripped (oil leak appeared). On the contrary, in almost sample Nos. 3 to 17 which the area-ratio were in the range of the invention, scuffing and oil dripping did not appear. Particularly in sample No. 2, one of the numerical limitation was satisfied, i.e., at least one pore having not less than 80 μm of pore size existed per 1 mm² of the inner surface. However, in sample No. 2, the numerical limitation with respect to the area-ratio was not satisfied, so that scuffing appeared as mentioned above. Thus, reliability of the minimum limitation of the area-ratio of the invention was backed up.

(2) Number of Pores (not less than 80 μm of pore size existed per 1 mm²)

In sample Nos. 4, 7, 10 and 13, scuffing appeared although the area-ratio were in the range of the invention. The reason is that, in these samples, the numerical limitation of number of pores having invented pore size were not satisfied. Particularly, in sample No. 20, although the area-ratio was above the numerical limitation of the invention, number of pores having invented pore size was below the range of the invention, so that scuffing appeared.

As it can be clearly understood from the above, the numerical limitations of the invention with respect to the area-ratio and number of pores are related inseparably close each other, and the numerical limitations of the invention are indispensable to prevent scuffing and oil dripping.

B. EXAMPLE 2

[Manufacture of Samples]

A P powder, a BN powder and a $MgSiO_3$ powder were properly blended with a Cu powder and a graphite powder and a Fe powder, then the powdered mixture were compacted to form ring-shape samples having a dimension of ø11×ø×6.4×10 mm and a density of 6.8 g/cm³. Then, the green compacts were sintered in a reducing atmosphere at a temperature of 1,130° C. for 60 minutes. After this, reaming was carried out to a bore of each sample by using a cemented carbide reamer with a diameter of 7.0 mm. The samples were reamed with a cutting speed of 950 rpm and at a feed per revolution of 0.4 mm/rev. As to measurement of machinability, reaming was carried out to sintered sample (not reamed) at the following condition.

[Measurement of Mechanical Properties]

Hardness, radial crush strength, machinability and amount of wear were measured. The operation time which was necessary for reaming entire length of 10 mm of sample with prepared hole diameter of 6.4 mm by a cemented carbide reamer with a diameter of 7.0 mm was measured for estimation of machinability of the valve guide. Moreover, each sample was installed to the vertical valve guide wear tester used in Example 1, the valve penetrating the valve guide was moved reciprocately with applying a lateral load to the valve, and amount of with applying a lateral load to the valve, and amount of wear of the inner surface of the valve guide was measured. The wear test was carried out at a stroke frequency of 3000 rpm with a stroke length of 8 mm. The lateral load applied to the piston (valve) was 3 kgf, and the wear test was carried out in an exhaust gas at a temperature of 200° C. for 30 hours. The result of the wear test are shown in Table 2.

In Table 2, the cases in which radial crush strength was no more than 70 kgf/mm$^2$, machinability was not less than 10 s/10 mm, amount of wear was not less than 90 $\mu$m (scuffing appeared) were beyond the permissible limitation and indicated "NG". Furthermore, in Table 2, "*" is attached to the numerical value exceeding the numerical limitation mentioned on and after claim 3, and "☆" is attached to the numerical value below the numerical limitation mentioned on and after claim 3.

[Valuation of Property: Function of Cu]

In sample No 30, radial crush strength was less than 70 kgf/mm$^2$ and valuated "NG", amount of wear was large and scuffing appeared. The reason can be assumed that content of Cu was below the range (1.0 to 10.0%) of the invention (claim 3), so that strength of the matrix was not sufficient in sample No. 30. Moreover, in sample 59, radial crush strength was less than 70 kgf/mm$^2$ and valuated "NG". The reason can be assumed that content of Cu was above the maximum limitation of the invention, so that amount of Cu exceeded limit of solid solution thereof and excess Cu precipitated, and strength of the matrix declined.

TABLE 2

| Sample | Chemical Composition (wt %) | | | | | | Valuation Items | | | |
|---|---|---|---|---|---|---|---|---|---|---|
| | | | | | | | Hardness of Matrix | Radial Crush strength | Machin-ability | Amount of Wear |
| No. | Cu | C | Ni | P | BN | $MgSiO_3$ | (MHV) | (kgf/mm$^2$) | (sec/10 mm) | ($\mu$m) |
| 30 | 0.5☆ | 1.0 | — | — | — | — | — | 68 (NG) | 5.9 | 96 (NG) |
| 31 | 1.0 | 1.0 | — | — | — | — | — | 75 | 6.4 | 85 |
| 32 | 3.0 | 1.0 | — | — | — | — | — | 85 | 7.4 | 75 |
| 33 | 5.0 | 0.3☆ | — | — | — | — | — | 64 (NG) | 5.5 | 110 (NG) |
| 34 | 5.0 | 0.6 | — | — | — | — | — | 76 | 6.6 | 78 |
| 35 | 5.0 | 0.8 | — | — | — | — | — | 88 | 7.8 | 61 |
| 36 | 5.0 | 1.0 | — | — | — | — | 315 | 90 | 8.3 | 58 |
| 37 | 5.0 | 1.0 | — | — | — | 0.05 | — | 89 | 7.9 | 60 |
| 38 | 5.0 | 1.0 | — | — | — | 0.10 | — | 87 | 7.6 | 63 |
| 39 | 5.0 | 1.0 | — | — | — | 0.50 | — | 79 | 6.8 | 75 |
| 40 | 5.0 | 1.0 | — | — | — | 1.00 | — | 74 | 6.3 | 81 |
| 41 | 5.0 | 1.0 | — | — | — | 1.20* | — | 62 (NG) | 5.3 | 115 (NG) |
| 42 | 5.0 | 1.0 | — | — | 0.01 | — | — | 89 | 7.8 | 60 |
| 43 | 5.0 | 1.0 | — | — | 0.05 | — | — | 87 | 7.7 | 63 |
| 44 | 5.0 | 1.0 | — | — | 0.05 | 0.10 | — | 82 | 7.2 | 72 |
| 45 | 5.0 | 1.0 | — | — | 0.10 | — | — | 84 | 7.3 | 69 |
| 46 | 5.0 | 1.0 | — | — | 0.50 | — | — | 76 | 6.5 | 78 |
| 47 | 5.0 | 1.0 | — | — | 0.80* | — | — | 67 (NG) | 5.8 | 98 (NG) |
| 48 | 5.0 | 1.0 | — | 0.1 | — | — | — | 92 | 8.6 | 56 |
| 49 | 5.0 | 1.0 | — | 0.2 | — | — | — | 94 | 9.0 | 54 |
| 50 | 5.0 | 1.0 | — | 0.3* | — | — | — | 86 | 13.2 (NG) | 51 |
| 51 | 5.0 | 1.0 | 0.5 | — | — | — | 320 | — | 8.3 | 54 |
| 52 | 5.0 | 1.0 | 1.0 | — | — | — | 330 | — | 8.5 | 48 |
| 53 | 5.0 | 1.0 | 3.0 | — | — | — | 373 | — | 9.0 | 44 |
| 54 | 5.0 | 1.0 | 5.0* | — | — | — | 380 | — | 15.1 (NG) | 42 |
| 55 | 5.0 | 1.2 | — | — | — | — | — | 80 | 8.6 | 56 |
| 56 | 5.0 | 1.5* | — | — | — | — | — | 68 (NG) | 14.7 (NG) | 47 |
| 57 | 7.0 | 1.0 | — | — | — | — | — | 86 | 7.6 | 55 |
| 58 | 10.0 | 1.0 | — | — | — | — | — | 76 | 6.6 | 53 |
| 59 | 12.0* | 1.0 | — | — | — | — | — | 69 (NG) | 6.0 | 53 |

Balance: Fe

[Valuation of Property: Function of C]

In sample No. 33, radial crush strength was less than 70 kgf/mm$^2$ and valuated "NG", amount of wear was large and scuffing appeared. The reason can be assumed that content of C was below the range (0.6 to 1.2%) of the invention (claim 3), so that pearlite did not precipitate sufficiently in sample No. 33. Moreover, in sample No. 56, radial crush strength was less than 70 kgf/mm$^2$ and valuated "NG", and machinability declined. The reason can be assumed that content of C was above the maximum limitation of the invention, so that brittle cementite reticulately precipitated at grain boundary.

[Valuation of Property: Function of Ni]

In sample Nos. 51 to 54 including Ni which was an effective element for strength of matrix, amount of wear was small and wear resistance was high. Comparing sample No. 36 including no Ni with sample Nos. 51 to 54 including Ni, the value of micro vickers hardness (MHV) of sample Nos. 51 to 54 was generally high. Furthermore, MHV increased according to content of Ni, thus, the effect of including Ni clearly appeared. However, in sample No. 54, content of Ni exceeded the maximum limitation (no more than 3%) of the invention (claim 4), so that a portion of matrix transformed to martensite and machinability was valuated "NG".

[Valuation of Property: Function of BN and $MgSiO_3$]

In sample Nos. 37 to 47 which included machinability improving element of BN or $MgSiO_3$, the operation time for reaming were generally short compared to other samples, and machinability was sufficient. However, in sample No. 41, radial crush strength was valuated "NG". The reason can be assumed that the content of $MgSiO_3$ was above the maximum limitation (no more than 1.0%) of the invention (claim 5) in sample No. 41, so that progress of sintering was obstructed. Moreover, in sample No. 47, radial crush strength was valuated "NG". The reason can be assumed that the content of BN was above the maximum limitation (no more than 0.5%) of the invention (claim 5) in sample No. 47, so that progress of sintering was obstructed similarly.

[Valuation of Property: Function of P]

In sample Nos. 48 to 50 including P which strengthened the matrix, amount of wear was small and wear resistance was sufficient. However, In sample 50 in which content of P was above the range (no more than 0.2%) of the invention (claim 6,7), steadite precipitated in the matrix, so that machinability declined and was valuated "NG".

C. EXAMPLE 3

Example of Manufacturing Process

[Manufacture of Samples]

Powdered mixture including a Fe powder or a Cu powder having not less than 74 μm to no more than 250 μm of particle size in various element components were prepared, and samples were manufactured by the same process as Example 1. Then, wear test was carried out at the same condition as Example 1, and appearance of scuffing was observed. The result is shown in Table 3.

As shown in Table 3, in the sample including no less than 90% of Fe powder having not less than 74 μm to no more than 250 μm of particle size, good or best result was obtained. On the contrary, in the sample including 80% of Fe powder having not less than 74 μm to no more than 250 μm of particle size, scuffing appeared. Moreover, in the samples including no less than 30% of Cu powder having 74 to 250 μm of particle size, good or best result was obtained. On the contrary, in the sample including no 20% of Cu powder having not less than 74 μm to no more than 250 μm of particle size, scuffing appeared.

TABLE 3

| Content of Fe Powder having 74~250 μm of Particle Size (wt %) | Valuation | Remark |
|---|---|---|
| 80 | No Good | Scuffing |
| 90 | Good | Good |
| 95 | Very Good | Best |
| 100 | Very Good | Best |
| **Content of Cu Powder having 74~250 μm of Particle Size (wt %)** | **Valuation** | **Remark** |
| 20 | No good | Scuffing |
| 30 | Very Good | Best |
| 50 | Very Good | Best |
| 80 | Very Good | Best |
| 100 | Very Good | Best |

D. EXAMPLE 4

Sample No. 60 manufactured by a powdered mixture including Cu powder which included not less than 30% of less than 74 μm to no more than 250 μm of particle size with respect to entire Cu powder, and sample No. 61 manufactured by a powdered mixture blended a Ni powder with the powdered mixture of sample 60 were prepared. Comparative sample Nos. 1 and 2 in which the matrix structures were mainly constructed by martensite were prepared. Comparative sample Nos. 1 and 2 were obtained by treating a heat treatment including quench hardening and tempering to the same samples as sample Nos. 60 and 61 respectively. Comparative sample No. 3 obtained by dispersing $MgSiO_3$ in the matrix of comparative sample No. 1 was prepared. Moreover, a conventional valve guide having the same chemical composition as disclosed in Japanese Patent Laid Open No. 1992-57140 (comparative sample 4) was prepared. The chemical composition of sample Nos. 60 and 61, and comparative sample Nos. 1 to 4 are shown in Table 4.

TABLE 4

| Sample No. | Chemical Composition (wt %) Fe | Cu | Ni | C | P | $MgSiO_3$ | Matrix Structure |
|---|---|---|---|---|---|---|---|
| 60 | Balance | 5.0 | — | 1.0 | — | — | Pearlite |
| 61 | Balance | 5.0 | 1.0 | 1.0 | — | — | Pearlite + Bainite |
| Comparative Sample 1 | Balance | 5.0 | — | 1.0 | — | — | Martensite |
| Comparative Sample 2 | Balance | 5.0 | 1.0 | 1.0 | — | — | Martensite + Austenite |
| Comparative Sample 3 | Balance | 5.0 | — | 1.0 | — | 0.6 | Martensite |
| Comparative Sample 4 | Balance | 4.0 | — | 2.0 | 0.6 | 0.6 | Pearlite + Steadite |

| Sample No. | Area-Ratio (%) | Number of Pores having not less than 80 μm of Pore Size | Amount of Wear (μm) | Machinability (sec/10 mm) |
|---|---|---|---|---|
| 60 | 5.1 | 1 | 57 | 8.3 |
| 61 | 6.4 | 3 | 46 | 8.5 |
| Comparative Sample 1 | 8.6 | 4 | 40 | 15.1 |
| Comparative Sample 2 | 8.8 | 4 | 39 | 14.7 |
| Comparative Sample 3 | 8.4 | 4 | 41 | 13.0 |
| Comparative Sample 4 | 3.2 | 1 | 60 | 12.6 |

A wear test was carried out at the same condition as Example 2. Amount of wear and measurement of machinability with respect to the above samples are shown in Table 4. The reaming condition was the same as Example 2.

As clearly shown in Table 4, in samples Nos. 60 and 61 of the invention and comparative sample Nos. 1 to 3, area-ratio of pores exposed on the inner surface after machined was 2.7 to 10.7%, and at least one pore having not less than 80 μm was exposed per 1 $mm^2$ of the inner surface, so that amount of wear was small and wear resistance was sufficient in comparison with the result of research of wear resistance (amount of wear) shown in Table 2.

However, as clearly shown in Table 4, in sample Nos. 60 and 61 of the invention with no hard phase, operating time for reaming was short and machinability was superior in comparison with comparative sample Nos. 1 and 2 mainly having matrix of martensite, comparative sample No. 3 having improved machinability by adding free cutting element in the matrix of martensite, and the conventional valve guide (comparative sample No. 4) having hard phase.

Thus, it can be clearly understood that both of wear resistance and machinability are improved in the valve guide manufactured by the present invention.

As described the above, in the present invention, sliding portion can be suitably lubricated, so that appearance of scuffing of valve stem and leak of lubricating oil can be prevented (claims 1, 8 and 14). Furthermore, in the present invention, machinability can be improved remaining wear resistance (claims 3, 4 and 6), and machinability can be further improved (claim 5).

What is claimed is:

1. A valve guide manufactured by sintered alloy, said valve guide comprising an inner surface sliding with a valve stem, said inner surface finished by machining and exposing pores, area-ratio of the exposed pores with respect to the inner surface being 2.7 to 10.7%, and at least one pore having pore size of not less than 80 $\mu$m existing per 1 $mm^2$ of the inner surface.

2. A valve guide according to claim 1, wherein said area-ratio of the pores with respect to the inner surface is 3.0 to 10.0%.

3. A valve guide according to claim 1, wherein said sintered alloy comprises:

1.0 to 10.0% by weight of Cu;

0.6 to 1.2% by weight of C; and balance of Fe and inevitable impurity; and matrix structure constructed by essentially pearlite or composite structure of pearlite and bainite, said sintered alloy does not include hard phase.

4. A valve guide according to claim 3, wherein said sintered alloy comprises at least one of:

0.01 to 0.5% by weight of BN; and 0.05 to 1.0% by weight of $MgSiO_3$.

5. A valve guide according to claim 3, wherein said sintered alloy further comprises no more than 0.2% by weight of P.

6. A valve guide according to claim 4, wherein said sintered alloy further comprises no more than 0.2% by weight of P.

7. A valve guide according to claim 1, wherein said sintered alloy comprises:

1.0 to 10.0% by weight of Cu;

0.6 to 1.2% by weight of C;

more than 0 to no more than 3% by weight of Ni; and balance of Fe and inevitable impurity; and matrix structure constructed by essentially pearlite or composite structure of pearlite and bainite, said sintered alloy does not include hard phase.

* * * * *

UNITED STATES PATENT AND TRADEMARK OFFICE

CERTIFICATE OF CORRECTION

PATENT NO. : 6,012,703
DATED : April 19, 2000
INVENTOR(S) : Koichiro Hayashi, et al.

It is certified that error appears in the above-identified patent and that said Letters Patent is hereby corrected as shown below:

Column 11,
Line 57 and 58: "30% of less than 74" should read --30% of Cu powder having not less than --

Column 13,
Line 6, :"exposed pores" should read -- pores exposed --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*